US007455752B2

(12) United States Patent
Hansen

(10) Patent No.: US 7,455,752 B2
(45) Date of Patent: Nov. 25, 2008

(54) SEMI-PERMEABLE FABRICS FOR TRANSFER BELT AND PRESS FABRIC APPLICATIONS

(75) Inventor: Robert A. Hansen, Stuttgart-Birkach (DE)

(73) Assignee: Albany International Corp., Albany, NY (US)

( * ) Notice: Subject to any disclaimer, the term of this patent is extended or adjusted under 35 U.S.C. 154(b) by 859 days.

(21) Appl. No.: 10/896,532

(22) Filed: Jul. 22, 2004

(65) Prior Publication Data

US 2006/0016545 A1 Jan. 26, 2006

(51) Int. Cl.
*D21F 7/08* (2006.01)
*D04H 1/54* (2006.01)

(52) U.S. Cl. ..... 162/358.2; 162/900; 156/148; 156/309.6; 442/197; 442/263; 442/310

(58) Field of Classification Search ..... 162/116, 162/348, 358.2, 358.4, 900–904; 28/110, 28/142; 156/148, 155, 309.6; 442/197, 243–245, 442/263, 310; 139/383 A, 383 AA, 425 A
See application file for complete search history.

(56) References Cited

U.S. PATENT DOCUMENTS

| | | | | |
|---|---|---|---|---|
| 4,259,394 | A | 3/1981 | Khan | |
| 4,382,987 | A * | 5/1983 | Smart | 428/212 |
| 4,467,839 | A | 8/1984 | Westhead | |
| 4,489,125 | A * | 12/1984 | Gagnon | 442/3 |
| 4,565,735 | A | 1/1986 | Murka, Jr. et al. | |
| 4,632,716 | A | 12/1986 | Smith | |
| 4,798,760 | A * | 1/1989 | Diaz-Kotti | 442/35 |
| 4,806,413 | A * | 2/1989 | Penven | 428/222 |
| 4,830,915 | A | 5/1989 | Diaz-Kotti | |
| 5,173,355 | A | 12/1992 | Vock et al. | |
| 5,298,124 | A | 3/1994 | Eklund et al. | |
| 5,360,656 | A | 11/1994 | Rexfelt et al. | |
| 5,549,967 | A | 8/1996 | Gstrein | |
| 5,766,391 | A | 6/1998 | Fletcher | |
| 6,036,819 | A | 3/2000 | Miller et al. | |
| 2005/0081570 | A1 * | 4/2005 | Karlsson et al. | 66/202 |
| 2005/0181694 | A1 * | 8/2005 | Crook et al. | 442/270 |

FOREIGN PATENT DOCUMENTS

DE 297 06 427 U1 7/1997

(Continued)

OTHER PUBLICATIONS

Simonds, H.R., et al., Handbook of Plastics, D. Van Nostrand Company, Inc., pp. 1093-1095 (1949).*

*Primary Examiner*—Eric Hug
(74) *Attorney, Agent, or Firm*—Frommer Lawrence & Haug LLP; Ronald R. Santucci

(57) ABSTRACT

A papermaker's fabric formed by arranging a number of layers in a predetermined manner, wherein at least one layer comprises a material which is woven, knitted or braided and has a first melting point temperature and wherein each of the remaining layers has a melting point temperature which is higher than said first melting point temperature; and heating said number of layers to a temperature at least equal to said first melting point temperature and less than said melting point temperature of each of the remaining layers such that said at least one layer melts without melting the remaining layers.

18 Claims, 3 Drawing Sheets

FOREIGN PATENT DOCUMENTS

| | | | |
|---|---|---|---|
| EP | 1 127 976 A | | 8/2001 |
| EP | 1 270 807 | * | 1/2003 |
| GB | 1081362 | * | 8/1967 |
| JP | 2000-170086 | * | 6/2000 |
| WO | WO 00/51801 | | 9/2000 |
| WO | WO 00/61864 | | 10/2000 |

* cited by examiner

SEMI-PERMEABLE FABRICS FOR TRANSFER BELT AND PRESS FABRIC APPLICATIONS

BACKGROUND OF THE INVENTION

1. Field of the Invention

The present invention relates to the papermaking arts. More specifically the present invention relates to a papermaker's fabric for use in transfer belts and press fabric applications.

2. Description of the Prior Art

During the papermaking process, a cellulosic fibrous web is formed by depositing a fibrous slurry, that is, an aqueous dispersion of the cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another, and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, papermaker's fabric manufacturers are required to produce press fabrics, and other papermaker's fabric to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In addition, transfer belts relate to the transfer of a paper sheet between sections, or between elements of a section, such as the individual presses in a press section, of a papermachine. Transfer belts may be designed both to carry a paper sheet through a portion of a papermachine, and to allow for paper dewatering.

As noted above, the primary function of all papermaker's fabric is removal of water from the paper sheet. Further, criteria such as smooth surfaces and uniformity are important factors to be considered for a papermaker's fabric. The surface topography of papermaker's fabrics contributes to the quality of the paper product. Efforts have been made to create a smoother contact surface with the paper sheet. However, surface smoothness or pressure uniformity of a papermaker's fabric is limited by the topography resulting from the weave pattern and the filament physical properties underneath the needled batt. In a woven fabric (or knitted fabric), smoothness is inherently limited by the knuckles formed at the cross-over points of intersecting yarns. Thus, there is a need for fabrics with superior smoothness characteristics and uniformity.

The prior art includes melting non-woven materials in a papermaker's fabric, such as fiber batt material or a layer of spunbound materials. The location and placement of fibers in a needled batt are non-uniform and cannot be predicted nor repeated from fabric to fabric. The same is true if a film of "meltable" material is used as the film will flow, usually in the direction of a heat source. However, the flow has tended to be non-uniform; plus these films or "sheaths" of the prior art do little to mask the non-uniformity of pressure distribution attributed to the base fabrics that make up the support structure of the press fabric.

For example, U.S. Pat. No. 4,565,735 is a papermaker's felt with a compressive batt layer needled to one or both sides of a woven base layer. The batt layer(s) are formed from a mixture of at least two types of fibers. The first type is present in only small quantities and has a melting point lower than the remainder of batt layer(s) and the base fabric. The felt is heated to a temperature above this lower melting point and the first fibers melt to bond the remainder together and to the base fabric. While some localized improvement in fiber to fiber bonding has occurred, little is done to improve either surface smoothness or masking of the base fabric.

U.S. Pat. No. 4,830,915 is a paper machine wet-press felt having multiple layers of non-woven batt fibers alternating with layers of polymeric mesh interposed between them. The mesh layers have a lower melting point than the batt layers. The layers may be fixed by needling, sewing, heating or some combination of these. Each of the mesh layers is preferably a non-woven netting. During formation the felt may be heated to a temperature above the softening temperature of the polymeric mesh. However, it does not appear that the felt is heated to the melting point temperature of the polymeric mesh. As a result, smoothness and/or pressure uniformity may not be provided.

DE 297 06 427 U1 relates to a flexible band for use in paper machines. The band has at least one side which has an impermeable layer, and which features resilient compressibility comprising a fiber structure characterized in that the impermeable layer is formed by melting the fibers of the fiber structure on one side of the band. The fibrous layer or non-woven mat construction contains a predetermined portion of thermoplastically deformable threads, or hot melt adhesive thread. As previously mentioned, the location and placement of fibers in a non-woven mat are non-uniform and cannot be predicted nor repeated from fabric to fabric. Also disclosed are woven layers formed from so-called bicomponent threads. These threads are placed in a sheath of meltable polymers. Under the influence of heat, the above-mentioned sheath melts, while the thread itself is unaffected. The molten material so created is responsible for the adhesive connection. The thermoplastically deformable threads do not provide superior smoothness characteristics because only the sheath is melted and the core remains after melting.

Additionally, U.S. Pat. No. 5,298,124 (which is assigned to Albany International Corporation) describes a transfer belt, the teachings of which are incorporated herein by reference. The transfer belt may have a surface topography characterized by a pressure-responsive, recoverable degree of roughness, so that, when under compression in a press nip, the degree of roughness will decrease, thereby permitting a thin, continuous water film to be formed between the transfer belt and a paper sheet to bond the paper sheet to the transfer belt upon exit from the press nip. When the original degree of roughness returns sometime after exit from the nip, the paper sheet may be removed from the transfer belt, perhaps with the assistance of a minimal amount of vacuum or suction, to a permeable fabric, such as a dryer fabric.

The sheet transfer belt disclosed in U.S. Pat. No. 5,298,124 may comprise a reinforcing base with a paper side and a back side, and may have a polymer coating, which includes a balanced distribution having segments of at least one polymer, on the paper side. The balanced distribution takes the form of a polymeric matrix which may include both hydrophobic and hydrophilic polymer segments. The polymer coating may also include a particulate filler. The reinforcing base is designed to inhibit longitudinal and transverse deformation of the transfer belt, and may be a woven fabric, and, in addition, may be endless or seamable for closing into endless form during installation on the paper machine. The reinforcing base may have one or more fiber batt layers attached by needling to its back side. The fiber batt layer or layers, which may also be referred to as a needled web, are attached to the back side of the reinforcing base to control the impregnation of the polymer coating into the reinforcing base from the paper side during the manufacturing process. During the life of the transfer belt on a paper machine, the needled web protects the load-bearing yarns of the reinforcing base from damage by abrasion.

SUMMARY OF THE INVENTION

The present invention is directed towards a transfer belt or press fabric which has at least one woven, knitted, or braided layer which is meltable at a temperature lower than the remaining layers. The fabric is then subjected to a temperature which melts the meltable layer while leaving the rest of the structure technically intact. Such a layer has the advantage of predictable location and placement of the meltable material.

Accordingly, the present invention is a papermaker's fabric and a method of forming a papermaker's fabric including the steps of: arranging a number of layers in a predetermined manner, wherein at least one layer comprises a material which is woven, knitted or braided and has a first melting point temperature and wherein each of the remaining layers has a melting point temperature which is higher than said first melting point temperature; and heating the number of layers to a temperature at least equal to the first melting point temperature and less than the melting point temperature of each of the remaining layers such that the at least one layer melts without melting the remaining layers.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
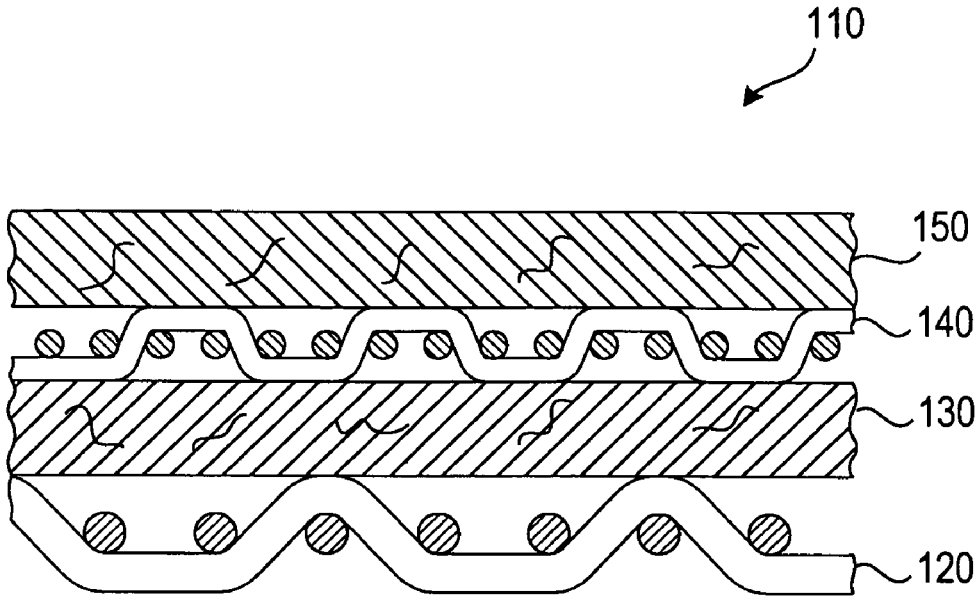
FIG. 1 is a cross-sectional view of papermaker's fabric composed of a number of layers having one meltable woven, braided or knitted layer according to the invention.

The invention is applicable to fabrics used in press sections and other sections of a paper machine, as well as to those used in other industrial settings, including but not limited to transfer belt fabrics, last press fabrics, tissue pickup fabrics, and glazing fabrics.

The inventive papermaker's fabric involves the production of an endless, continuous fabric that is truly endless or that contains a seam that will allow installation of the product in a similar fashion as a seamed press fabric, which is known in the industry. This fabric may include a carrier layer, i.e., a base fabric.

The carrier layer may be any one of the structures used as bases for paper machine clothing, such as a woven, non-woven, braided or knitted fabric, an extruded sheet of polymeric resin material, an extruded mesh fabric, or a spiral-link fabric. The carrier layer may also be assembled from a strip of one of these materials spirally wound in a plurality of turns, each turn being joined to those adjacent thereto by a continuous seam.

The carrier layer may also be a laminated structure comprising two or more base fabrics, each of which may be one of the structures described above. Where the carrier layer is laminated, one of the component base fabrics may be an on-machine-seamable fabric, so that the belt may be seamed into endless form during installation on a paper machine.

The carrier layer may further be needled with a batt of staple fiber material.

One or more layers of staple fiber batt material may be needled into the carrier layer, and the web may extend partially or completely there through. The web of staple fiber batt material may also form a layer covering a surface of the carrier layer.

The staple fiber batt material needled into the carrier layer may be any of the synthetic polymeric resins used by those skilled in the art, such as polyamide.

The carrier layer may be woven, or otherwise assembled, from yarns comprising yarns of any of the varieties used in the manufacture of paper machine clothing and industrial process fabrics. That is to say, the carrier layer may include monofilament, plied monofilament, multifilament, plied multifilament or yarns spun from staple fibers of any of the synthetic polymeric resins used by those skilled in the art.

At least one layer in the papermaker's fabric includes a meltable layer, that is woven, knitted or braided and has a melting point temperature that is lower than that of each of the remaining layers in the papermaker's fabric. The meltable layer may be woven, braided or otherwise assembled, from yarns comprising yarns of any of the varieties used in the manufacture of papermaker's fabric. That is to say, the meltable layer includes a material that has a lower melting point temperature than each of the remaining layers of the structure, so called "low-melt material". For example, the meltable layer may be manufactured from yarns of the following materials: polyethylenes, polypropylenes, low melting point polyamides, polyurethanes, polyolefins or other materials so used by those skilled in the art. The meltable layer may include 100% low-melt materials or a combination of low-melt materials and other materials having a higher melting point temperature. For example, a meltable layer having 100% low-melt material may be used in a sheet transfer belt. However, there may be applications where complete melting is not desired, for example, to obtain a desired porosity (permeability). Accordingly, a meltable layer may include less than 100% low-melt materials. That is, the meltable layer may contain non-melt materials. Further, the woven, knitted or braided material may be a single layer weave or a multilayer structure suitable for this purpose.

These layers may then be arranged in a predetermined manner with the proviso that at least one layer includes a material having a melting point temperature significantly lower than the remaining layers. This meltable fiber layer or layers may be any layer of the structure, for example, a layer on top of or below the carrier layer, or anywhere within the needled batt structure, including directly beneath the top layer of batt fibers, or any layer in between. In addition, the meltable layer(s) may also be placed directly on any surface of the fabric.

The layers may be combined via needling, lamination, or other methods so used by those skilled in the art.

The resulting structure is then exposed to temperatures that allow the meltable layer to melt while leaving the rest of the layers of the structure technically intact, i.e. not damaged or melted as a result of the process. That is, the layers are heated to a temperature at least equal to the first melting point temperature and less than the melting point temperature of each of the remaining layers such that the at least one meltable layer melts without melting the remaining layers of the structure. The resulting product provides a permeable fabric with superior smoothness and/or pressure uniformity. Because the meltable layer is woven, knitted or braided, the meltable material is uniformly and predictably distributed within the resultant structure as compared with non-woven fibrous materials. Further, unlike non-woven fibrous meltable materials, the woven, knitted or braided meltable layer provides known locations of the meltable material(s) with accuracy. Also, an impermeable structure can be created as well, if desired. Furthermore, the meltable material maintains some integrity even after "melting", unlike prior art fabrics.

Accordingly, the fabric of the invention may be permeable or impermeable. Further, the fabric of the invention may have improved pressure uniformity due to the woven, knitted or braided meltable layer "masking" nonuniformities inherent in the carrier layer.

Turning now more particularly to the drawings, FIG. 1 illustrates a papermaker's fabric (110) shown in a side cross-sectional view. Advantageously, the invention may be applied to a wide range papermaker's fabrics, including but not limited to transfer belts, last press fabrics, tissue pickup fabrics, and glazing fabrics, with a flexible range of properties for many different applications in the paper industry.

In the example shown in FIG. 1, papermaker's fabric (110) is composed of carrier layer (120), needled batt fiber layer (130) and (150), and meltable woven braided, or knitted layer (140). In this example, meltable layer (140) comprises a material which is woven, knitted or braided and has a first melting point temperature. In addition, carrier layer (120), needled batt fiber layers (130) and (150) are each composed of materials having a melting point temperature higher than that of meltable layer (140). After the layers are arranged, they may be combined in any one of the method so used by those of skill in the art, such as needling or lamination. After the layers are combined together, the structure is heated to the first melting point temperature.

Figure 2:
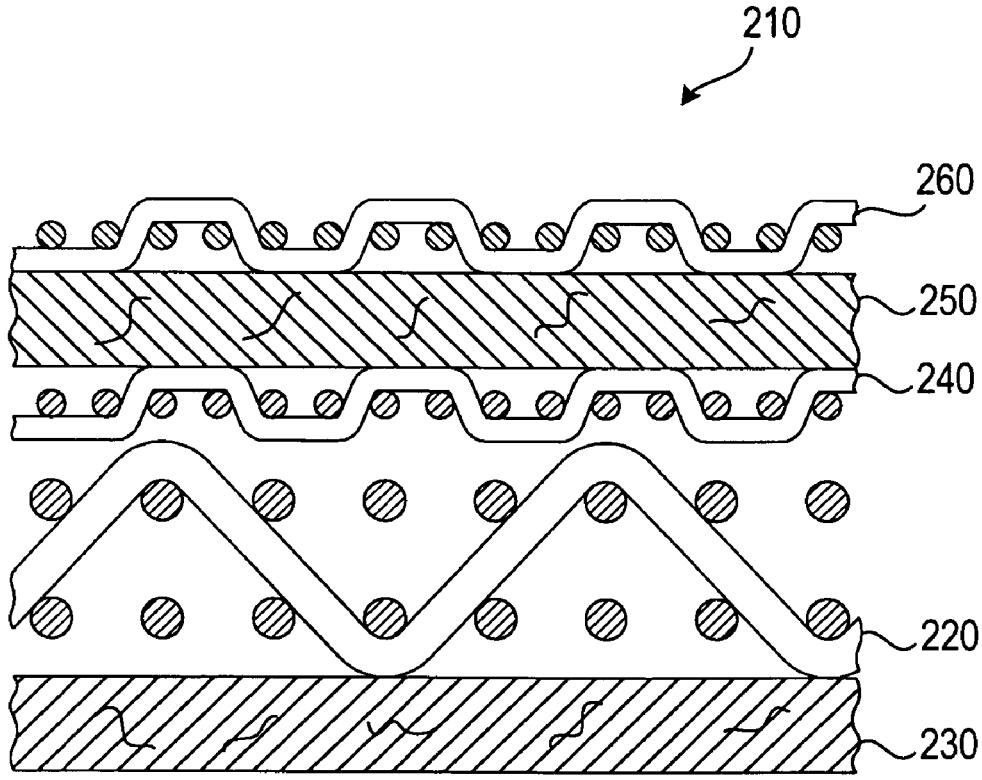
FIG. 2 is a cross-sectional view of a first alternative embodiment of a papermaker's fabric composed of a number of layers having two meltable woven, braided or knitted layers according to the invention.

FIG. 2 illustrates papermaker's fabric (210) shown in a side cross-sectional view. Papermaker's fabric (210) is composed of carrier layer (220), needled batt fiber layers (230) and (250), and meltable woven, braided or knitted layers (240) and (260). Meltable layers (240) and (260) comprise materials which are woven, knitted or braided and each have a melting point temperature lower than each of carrier layer (220), and needled batt fiber layers (230) and (250). As mentioned above, the layers are arranged, combined together, and subsequently heated.

Figure 3:
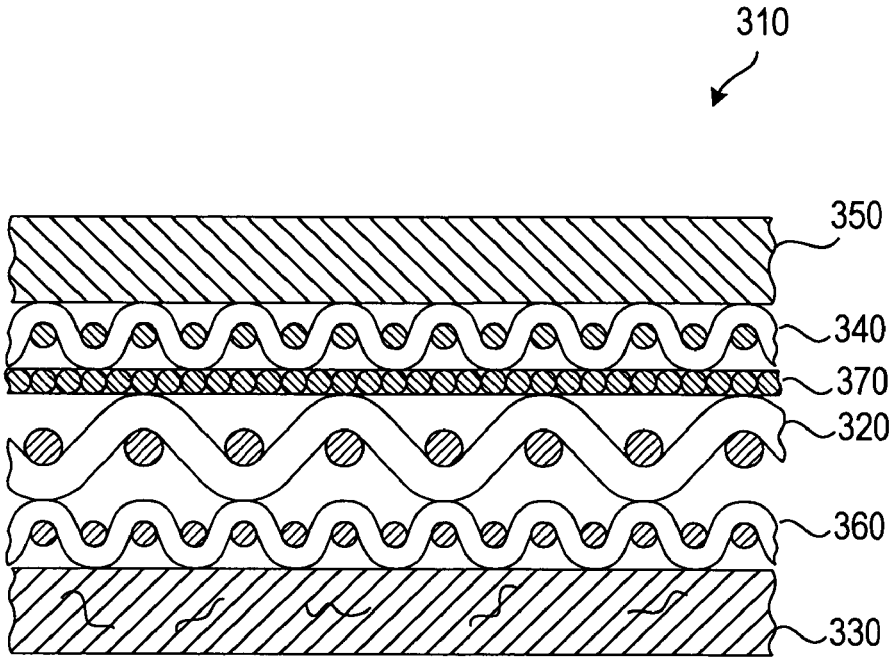
FIG. 3 is a cross-sectional view of a second alternative embodiment of a papermaker's fabric composed of a number of layers having two meltable woven, braided or knitted layers according to the invention.

FIG. 3 illustrates papermaker's fabric (310) shown in a side cross-sectional view. Papermaker's fabric (310) is composed of carrier layer (320), needled batt fiber layer (330), yarn layer (370) (which may be woven, non-woven, or spiral wound), non-woven layer (350), and meltable woven, braided or knitted layers (340) and (360). In the present example, yarn layer (370) may also be spiral wound and may or may not contain non-woven materials. Meltable layers (340) and (360) comprises a material which is woven, knitted or braided and have a melting point temperature that is lower that each of carrier layer (320), needled batt fiber layer (330), yarn layer (370), and non-woven layer (350). As mentioned above, the layers are arranged, laminated and subsequently heated.

Figure 4:
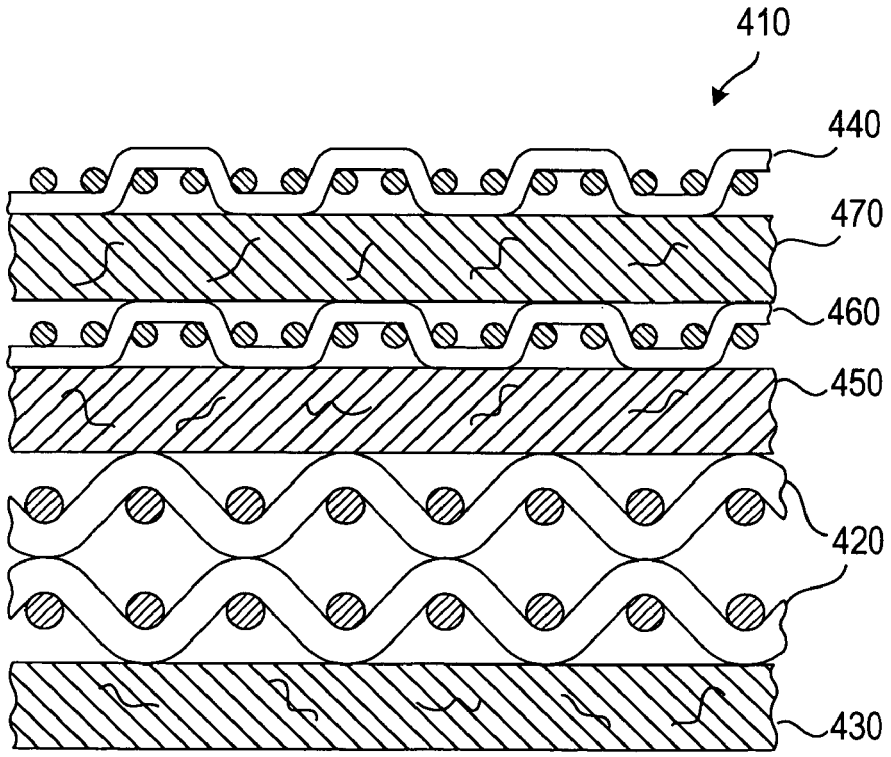
FIG. 4 is a cross-sectional view of a third alternative embodiment of a papermaker's fabric composed of a number of layers having two meltable woven, braided or knitted layers according to the invention.

FIG. 4 illustrates papermaker's fabric (410) shown in a side cross-sectional view. Papermaker's fabric (410) is composed of carrier layer (420), layers (430), (450) and (470), which can be non-woven, spun bonded or fiber batt, and meltable layers (440) and (460). In the present example, carrier layer (420) is a warp-knit fabric. Meltable layers (440) and (460) comprise a material which is woven, knitted or braided and have a melting point temperature that is lower that each of carrier layer (420) and layers (430), (450) and (470). As mentioned above, the layers are arranged, combined together, and subsequently heated.

Figure 5:
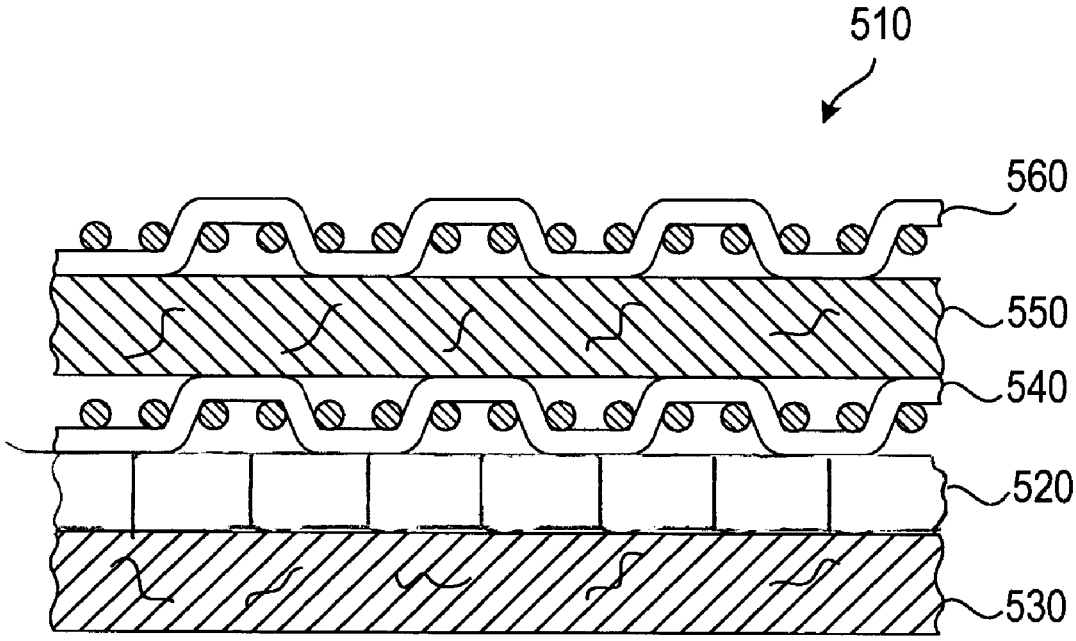
FIG. 5 is a cross-sectional view of a fourth alternative embodiment of a papermaker's fabric composed of a number of layers having two meltable woven, braided or knitted layers according to the invention.

FIG. 5 illustrates papermaker's fabric (510) shown in a side cross-sectional view. Papermaker's fabric (510) is composed of carrier layer (520), layers (530) and (550), which can be non-woven or fiber batt, and meltable layers (540) and (560). In the present example, carrier layer (520) may be manufactured by a spirally wound strip of material. Meltable layers (540) and (560) comprises a material which is woven or braided and have a melting point temperature that is lower that each of carrier layer (520) and layers (530) and (550). As mentioned above, the layers are arranged, combined together, and subsequently heated.

Figure 6:
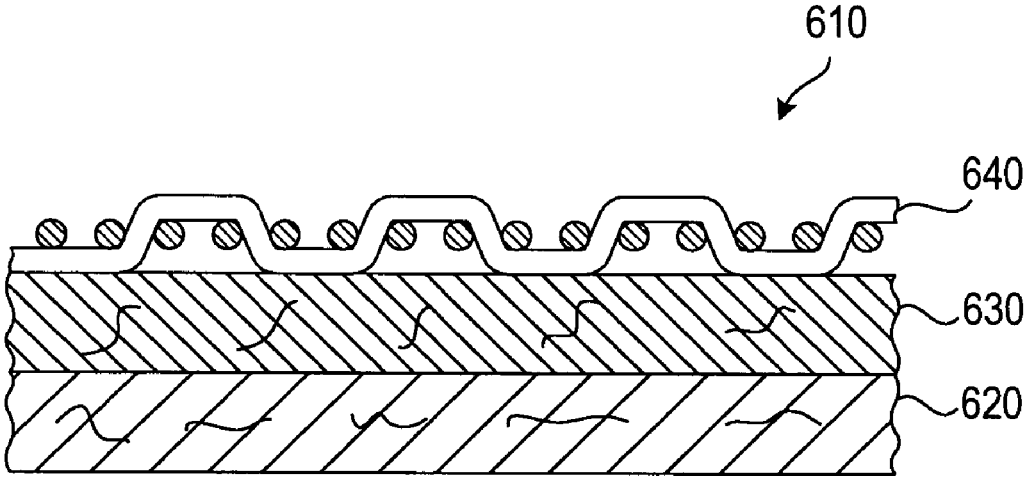
FIG. 6 is a cross-sectional view of a fifth alternative embodiment of a papermaker's fabric composed of a number of layers having a meltable woven, braided or knitted layer according to the invention.

FIG. 6 illustrates papermaker's fabric (610) shown in a side cross-sectional view. Papermaker's fabric (610) is composed of carrier layer (620), layer (630), which can be non-woven or fiber batt, and meltable layer (640). Meltable layer (640) comprises a material which is woven, knitted or braided and has a melting point temperature that is lower that each of carrier layer (620) and layer (630). As mentioned above, the layers are arranged, combined together, and subsequently heated.

Modifications to the present invention would be obvious to those of ordinary skill in the art in view of this disclosure, but would not bring the invention so modified beyond the scope of the appended claims.

What is claimed is:

1. A method of forming a papermaker's fabric comprising the steps of:

arranging a number of layers in a predetermined manner, wherein at least one layer comprises a material which is woven, knitted or braided and has a first melting point temperature and wherein each of the remaining layers has a melting point temperature which is higher than said first melting point temperature; and heating said number of layers to a temperature at least equal to said first melting point temperature and less than said melting point temperature of each of the remaining layers such that said at least one layer melts without melting the remaining layers.

2. The method of forming a papermaker's fabric according to claim 1, wherein a first layer comprises a carrier layer.

3. The method of forming a papermaker's fabric according to claim 2, wherein a second layer comprises a fiber batt.

4. The method of forming a papermaker's fabric according to claim 3, wherein the fiber batt is needled into said carrier layer and extending at least partially there through.

5. The method of forming a papermaker's fabric according to claim 2, wherein the carrier layer is woven, non-woven, knitted, braided, spiral-linked or a spirally wound strip of material.

6. The method of forming a papermaker's fabric according to claim 1, wherein said material is selected from the group consisting of polyethylenes, polypropylenes, polyamides, polyurethanes and polyolefins.

7. The method of forming a papermaker's fabric according to claim 1, wherein the papermaker's fabric is a press fabric.

8. The method of forming a papermaker's fabric according to claim 1, wherein the papermaker's fabric is a transfer belt.

9. The method according to claim 1, wherein the at least one layer is endless woven, flat woven, or a spirally wound strip of material.

10. A papermaker's fabric comprising a number of layers arranged in a predetermined manner in which at least one layer comprises a material which is woven, knitted or braided and has a first melting point temperature, and wherein each of the remaining layers has a melting point temperature which is higher than said first melting point temperature; and said at least one layer is melted when heated to a temperature at least equal to said first melting point temperature and less than the melting point temperature of each of the remaining layers such that said at least one layer melts without melting the remaining layers.

11. The papermaker's fabric according to claim 10, wherein a first layer comprise a carrier layer.

12. The papermaker's fabric according to claim 11, wherein a second layer comprises fiber batt.

13. The papermaker's fabric according to claim 12, wherein said fiber batt is needled into said carrier layer and extending at least partially there through.

14. The papermaker's fabric according to claim 11, wherein the carrier layer is woven, non-woven, knitted, braided, spiral-linked or a spirally wound strip of material.

15. The papermaker's fabric according to claim 10, wherein said material is selected from the group consisting of polyethylenes, polypropylenes, polyamides, polyurethanes and polyolefins.

16. The papermaker's fabric according to claim 10, wherein the papermaker's fabric is a press fabric.

17. The papermaker's fabric according to claim 10, wherein the papermaker's fabric is a transfer belt.

18. The papermaker's fabric according to claim 10, wherein the at least one layer is endless woven, flat woven, or a spirally wound strip of material.

* * * * *